US009861177B2

(12) United States Patent
Lefevre et al.

(10) Patent No.: US 9,861,177 B2
(45) Date of Patent: Jan. 9, 2018

(54) PACKAGING DEVICE FOR PACKAGING A FLUID REFILL

(71) Applicant: PARFUMS CHRISTIAN DIOR, Paris (FR)

(72) Inventors: Savine Lefevre, Compiegne (FR); Francois Gautier, Colombes (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 0 days.

(21) Appl. No.: 15/121,689

(22) PCT Filed: Feb. 23, 2015

(86) PCT No.: PCT/FR2015/050433

§ 371 (c)(1),
(2) Date: Aug. 25, 2016

(87) PCT Pub. No.: WO2015/128572

PCT Pub. Date: Sep. 3, 2015

(65) Prior Publication Data

US 2017/0000237 A1 Jan. 5, 2017

(30) Foreign Application Priority Data

Feb. 28, 2014 (FR) ..... 14 51625

(51) Int. Cl.
*A45D 40/00* (2006.01)
*A45D 34/02* (2006.01)
(Continued)

(52) U.S. Cl.
CPC ..... *A45D 40/0075* (2013.01); *A45D 34/00* (2013.01); *A45D 34/02* (2013.01);
(Continued)

(58) Field of Classification Search
CPC .... A45D 40/0075; A45D 34/00; A45D 34/02; A45D 2200/057; A45D 2034/005;
(Continued)

(56) References Cited

U.S. PATENT DOCUMENTS 3,080,989 A 3/1963 Ramsbotham
3,900,121 A 8/1975 Kruck
(Continued)

FOREIGN PATENT DOCUMENTS

EP 2095883 9/2009

OTHER PUBLICATIONS

International Search Report for PCT/FR2015/050433, dated Nov. 3, 2015, 5 pages including English translation.

*Primary Examiner* — Frederick C Nicolas
(74) *Attorney, Agent, or Firm* — Hamre, Schumann, Mueller & Larson, P.C.

(57) ABSTRACT

A packaging device for packaging a fluid refill, in particular for a cosmetic, the packaging device including a sheath having an open end, and a removable assembly that is suitable for being fastened in removable manner to the open end between a locked position in which the refill is held in the sheath, and an unlocked position in which the refill may be removed from the sheath. The removable assembly includes a retainer interface that co-operates with the open end and that presents an anchor member, and also an actuator member that co-operates with the retainer interface while being suitable for being moved axially relative thereto, so as to be taken into an actuated position in which the actuator member urges the anchor member to be anchored to the open end of the sheath, and a disengaged position in which it releases the anchor member.

20 Claims, 6 Drawing Sheets

(51) Int. Cl.
*B05B 11/02* (2006.01)
*A45D 34/00* (2006.01)
*B05B 11/00* (2006.01)

(52) U.S. Cl.
CPC ..... *B05B 11/0054* (2013.01); *B05B 11/3047* (2013.01); *A45D 2034/005* (2013.01); *A45D 2200/057* (2013.01); *B05B 11/0032* (2013.01); *B05B 11/0037* (2013.01)

(58) Field of Classification Search
CPC ..... B05B 11/0054; B05B 11/3047; B05B 11/0032; B05B 11/0037
See application file for complete search history.

(56) References Cited

U.S. PATENT DOCUMENTS

| | | | | | |
|---|---|---|---|---|---|
| 4,371,087 | A * | 2/1983 | Saujet | A45D 34/02 | 215/12.1 |
| 5,358,147 | A * | 10/1994 | Adams | B65D 83/386 | 222/183 |
| 5,499,747 | A | 3/1996 | Quennessen | | |
| 6,053,363 | A * | 4/2000 | Revenu | B05B 11/0037 | 222/183 |
| 6,569,387 | B1 * | 5/2003 | Furner | A01M 1/2033 | 222/183 |
| 8,079,498 | B2 * | 12/2011 | Anderson | A61L 9/14 | 222/183 |
| 8,459,508 | B2 * | 6/2013 | Westphal | B65D 83/386 | 222/131 |
| 9,757,751 | B2 * | 9/2017 | Chen | B05B 11/0091 | |
| 2016/0183661 | A1 * | 6/2016 | Lefevre | A45D 34/043 | 401/100 |

* cited by examiner

PACKAGING DEVICE FOR PACKAGING A FLUID REFILL

The present invention provides a packaging device for packaging a fluid refill, in particular for a cosmetic.

More particularly, the packaging device of the invention comprises a sheath having an open end, and a removable assembly that is suitable for being fastened in removable manner to the open end of the sheath between a locked position in which the refill is held in the sheath, and an unlocked position in which the refill may be removed from the sheath.

Devices of this type are known, in particular for cosmetic refills that might be of the spray, pump, or bottle type. Over the past few years, in particular in the field of cosmetics, this type of refill has been developed for the purpose of reducing the costs of manufacturing cosmetic packaging, and of reducing its impact on the environment.

An increasing need thus exists for existing packaging to be replaced little by little by packaging devices that receive cosmetic refills, in which event the packaging device itself may be retained once the cosmetic has been used, with only the refill being discarded. Once the refill is empty, it suffices for the user to unlock the removable assembly from the open end of the sheath and remove the refill in order to replace it with a new or a different refill. However, it is important firstly that the packaging device has the appearance qualities required by the user, and secondly that the manipulations for replacing a spent refill are also as simple as possible for the user.

Thus, the type of packaging device must be easy to use and must enable the refill that it contains to be removed easily and a new refill to be put into place easily, i.e. requiring little force or attention on the part of the user. The packaging device must also enable the removable assembly to be locked easily to the open end of the sheath. Furthermore, the refill must be held in the packaging device in reliable manner, i.e. the removable assembly must not pass into its unlocked position accidentally.

Packaging devices for packaging a fluid refill are known from U.S. Pat. No. 3,080,989, in which the removable assembly includes an actuator element that is held in the sheath and that is provided with resilient tongues that extend beyond the open end of the sheath. The removable assembly further includes a retainer cover that presents two openings and that is arranged on the sheath in such a manner that the bulges on the resilient tongues of the actuator element catch in the openings of said cover. In order to change the refill, it suffices for the user to press on the tongues of the actuator part so that they disengage from the cover, the cover thus being removable from the open end of the sheath. Conversely, in order to put a new refill in the packaging device, the retainer cover must be put into place until the bulges of the resilient tongues are engaged once again in the openings of said cover.

Such manipulations, in particular pressing on the tongues, may require a relatively large amount of force in order to disengage the tongues from the openings. In contrast, if the amount of force that must be exerted on the tongues in order to disengage them is not very large, there is a risk of the tongues becoming disengaged from the slots in unwanted manner. In addition, after the tongues have been manipulated many times, their hinges may weaken so that the tongues are no longer held in the bulges.

In addition, the packaging device is not reliable since the user may press unintentionally on the bulges of the tongues while manipulating the packaging device, causing them to disengage accidentally from the openings of the cover.

Furthermore, the overall appearance of the packaging device is relatively unattractive as a result of the bottom portion of the retainer cover being particularly visible.

An object of the present invention is to remedy the above-mentioned drawbacks substantially.

This object is achieved as a result of the removable assembly comprising both a retainer interface that co-operates with the open end of the sheath and that presents an anchor member, and also an actuator member that co-operates with the retainer interface while being suitable for being moved relative thereto, the actuator member thus being suitable for being taken, by an axial movement relative to the retainer interface, into an actuated position in which the actuator member urges the anchor member to be anchored to the open end of the sheath, and a disengaged position in which it releases the anchor member and enables the removable assembly to be disengaged from the open end of the sheath.

It should be understood that in order to anchor the anchor member to the open end of the sheath or to disengage it therefrom, it suffices for the user to press on the actuator member in the axial direction. Thus, when the actuator member reaches its actuated position, the removable assembly is locked to the open end of the sheath, and the refill is held in the sheath.

When the removable assembly is in its locked position, the user can use the refill as though it were being held directly in the user's hands. It should thus be understood that the packaging device does not interfere with the dispenser element of the refill.

Furthermore, since the movement that enables the anchor member to be anchored or released is axial, a wide range of choices is made available with regard to the appearance of the device, that need not necessarily have radially-projecting portions.

The refill may be of the type presenting a neck, as happens when it is a bottle, for example. In this configuration, the removable assembly may be arranged around the neck. The refill presents a control element for manipulating, e.g. a spray head, a stopper, or the like. In this configuration, the removable assembly is arranged so that the control element extends beyond the removable assembly.

The packaging device of the invention is thus reliable since there is little risk of the actuator member moving axially in unwanted manner, in particular when the user manipulates the control element of the refill so as to make it possible to use the fluid that it contains. Furthermore, when the user grips the packaging device at the sheath, the user's fingers are not in reach of the actuator member, thereby preventing the removable assembly from being unlocked accidentally.

When the actuator member reaches its disengaged position, the removable assembly is unlocked from the open end of the sheath and may be removed from the open end of the sheath. The user can then remove the used refill from the sheath and replace it with a new refill.

The packaging device of the invention is particularly simple and intuitive to use. In this embodiment, it suffices for the user to push the actuator member, e.g. by means of two thumbs, so as to lock the removable assembly to the open end of the sheath or to unlock it therefrom.

In certain embodiments, the removable assembly forms a unitary assembly.

The term "unitary assembly" should be understood to mean that the removable assembly is formed as a whole.

Thus, when the actuator member is unlocked from the open end of the sheath, the user removes the removable assembly from the open end of the sheath in a single operation, without any part of the assembly remaining in place on or in the sheath. Such arrangements make it easier to lock and unlock the removable assembly, and avoid the user misplacing a part of the removable assembly.

In certain embodiments, the removable assembly further includes thrust means that are suitable for urging the actuator member to move towards its disengaged position, after said member has moved axially from its actuated position.

Advantageously, the thrust means are arranged between a bottom wall of the retainer interface and the actuator member.

Such arrangements also facilitate manipulating the packaging device for passing the actuator member from its actuated position to its disengaged position.

In certain embodiments, the actuator member moves axially from its actuated position by means of said member being pushed towards the inside of the sheath (i.e. towards the bottom wall of the sheath), and said member moves axially towards its disengaged position by means of said member being thrust towards the outlet of the sheath (i.e. away from the bottom wall of the sheath).

It should be understood that in order to unlock the removable assembly from the open end of the sheath, the user presses on the actuator member towards the inside of the sheath while holding the sheath, so that the actuator member compresses the thrust means. Once the user stops pressing on the actuator member, the thrust means are "released" and they thrust the actuator member towards the outlet of the sheath, which reaches its disengaged position.

Advantageously, the thrust means comprise a spring. The spring may be a helical spring that is simple to manufacture and inexpensive.

In certain embodiments, one of the elements selected from among the actuator member and the retainer interface includes a follower pin that co-operates with at least one heart-shaped cam that is secured to the other element selected from among the actuator member and the retainer interface, said cam defining a heart-shaped path for the pin.

The operation of the heart-shaped cam is known per se. In the embodiment, the heart-shaped cam defines at least two stable positions for the follower pin on the heart-shaped path, one of the stable positions corresponding to the actuated position of the actuator member, and the other stable position corresponding to the disengaged position of the actuator member. Passing from one stable position to the other is performed by the actuator member moving axially relative to the retainer interface.

In certain embodiments, the follower pin is formed on a tab of one of the elements selected from among the retainer interface and the actuator member. By way of example, the follower pin is formed on a free end of said tab.

In certain embodiments, the retainer interface presents at least one anti-escape abutment that is arranged facing the tab so as to prevent the follower pin from escaping from the heart-shaped path.

By means of such arrangements, the follower pin remains correctly in position in the heart-shaped path and does not risk becoming disengaged therefrom. Thus, such arrangements make it possible to reinforce still further the reliability of the packaging device.

In certain embodiments, the anchor member includes at least one projection, in particular a rib, that is suitable for co-operating with at least one recess, in particular a groove, formed in the wall of the sheath, when the actuator member reaches its actuated position.

It should be understood that when the actuator member reaches it actuated position, the projection of the anchor member catches in the recess formed in the wall of the sheath. By means of such arrangements, the removable assembly is locked in reliable manner to the open end of the sheath. In order to reinforce still further the reliability of the packaging device so that the user avoids separating the projection from the recess, the recess need not be a through recess (i.e. it need not have the form of a slot), and this makes a wide range of choices available with regard to the appearance of the device).

Advantageously, the anchor member may include a tongue on which the projection is formed.

In a preferred possibility, the tongue is arranged inside the sheath and the projection is arranged on the face of the tongue that faces towards the wall of the sheath, i.e. facing the recess formed in the sheath.

In certain embodiments, the actuator member includes at least one presser surface that is suitable for pushing the tongue towards the wall of the sheath, so as to anchor the anchor member to the open end of the sheath.

While the actuator member is moving axially towards the bottom wall of the sheath, relative to the retainer interface, the presser surface of the actuator member progressively pushes the tongue of the anchor member towards the sheath until it reaches a position in which the projection of the tongue is engaged in the recess formed in the wall of the sheath.

In certain embodiments, the tongue is resilient and presents a natural position that does not enable the anchor member to be anchored to the open end of the sheath. For example, in this natural position, the tongue slopes towards the axis of the device, such that the outside diametral dimension of the projection is less than the diametral dimension of the recess.

When the tongue is not subjected to pressure exerted by the presser surface of the actuator member, said tongue returns automatically to its natural position, which causes the anchor member to be released from the sheath.

In certain embodiments, the retainer interface and the actuator member co-operate with each other via longitudinal guide surfaces.

Such arrangements make it possible to guarantee that the retainer interface and the actuator member move axially relative to each other, while preventing them from turning relative to each other.

The invention also provides a packaging assembly comprising a fluid refill and a packaging device as described above, wherein the removable assembly is arranged around the neck of the refill and/or around a control member of said refill.

DRAWINGS

The invention can be well understood and its advantages appear better on reading the following detailed description of an embodiment shown by way of non-limiting example. The description refers to the accompanying drawings, in which.

DETAIL DESCRIPTION

Figure 1A:
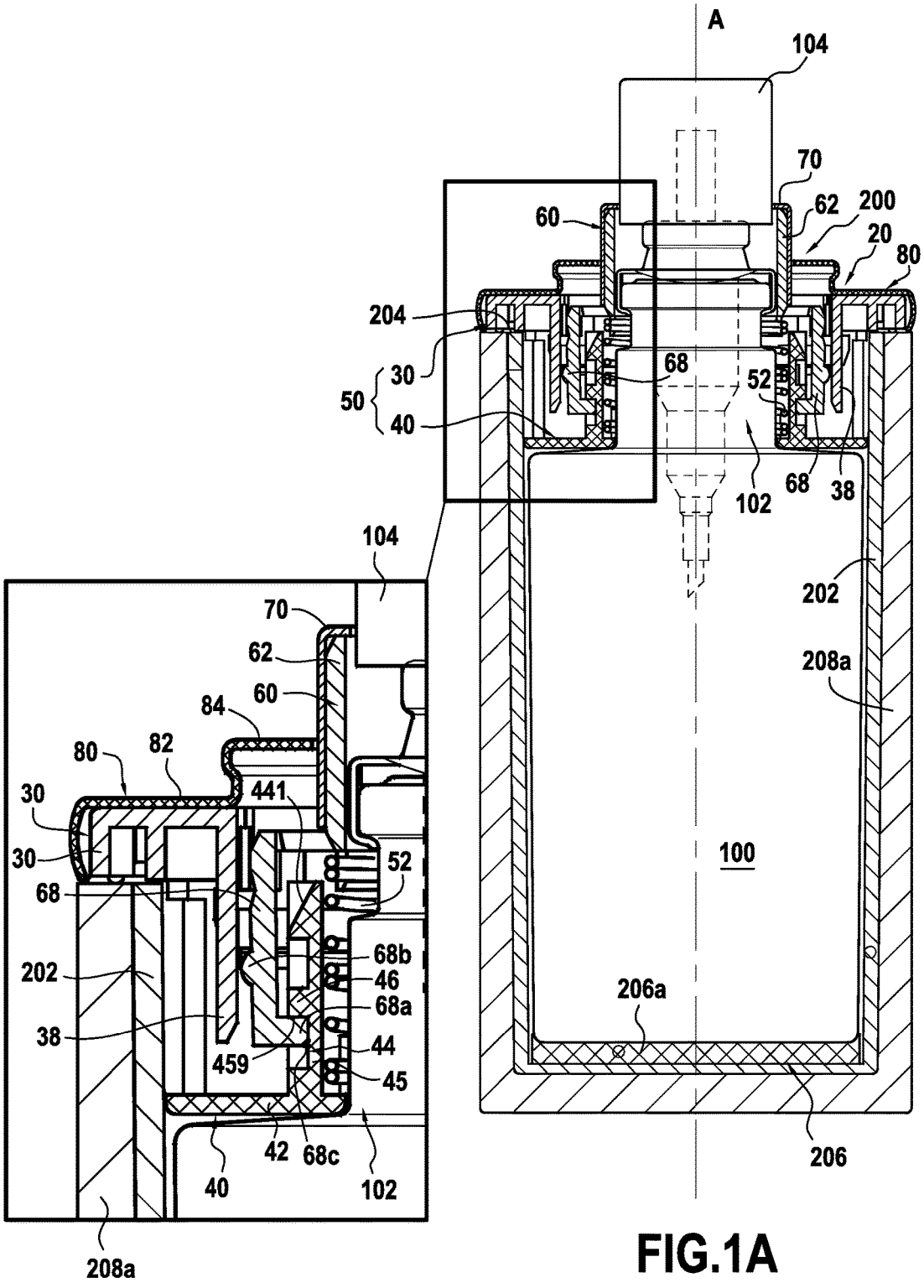
FIG. 1A is a longitudinal section view of the packaging assembly comprising the packaging device of the invention and a refill installed in the sheath of said device, the packaging device comprising a removable assembly shown in its position locked to the open end of the sheath.

A packaging assembly of the invention for packaging a cosmetic refill is described with reference to FIGS. 1A to 9.

The packaging assembly comprises a packaging device 200 and a cosmetic refill 100. In the invention, the packaging device 200 includes a sheath 202 having an open end 204 and a bottom wall 206 that is remote from the end 204.

The refill 100, forming a spray in this embodiment, includes a neck 102 and a control element 104 for manipulating, of the pushbutton type. The refill 100 is received in the sheath 202 and may be arranged pressing against an internal covering such as a foam 206*a* that is arranged on the bottom wall 206 of the sheath 202. The foam 206*a* makes it possible to damp impacts between the refill 100 and the bottom wall 206 of the sheath 202, and to wedge the refill 100 correctly in the sheath 202. The sheath 202 further includes a lower casing 208*a*.

Figure 9:
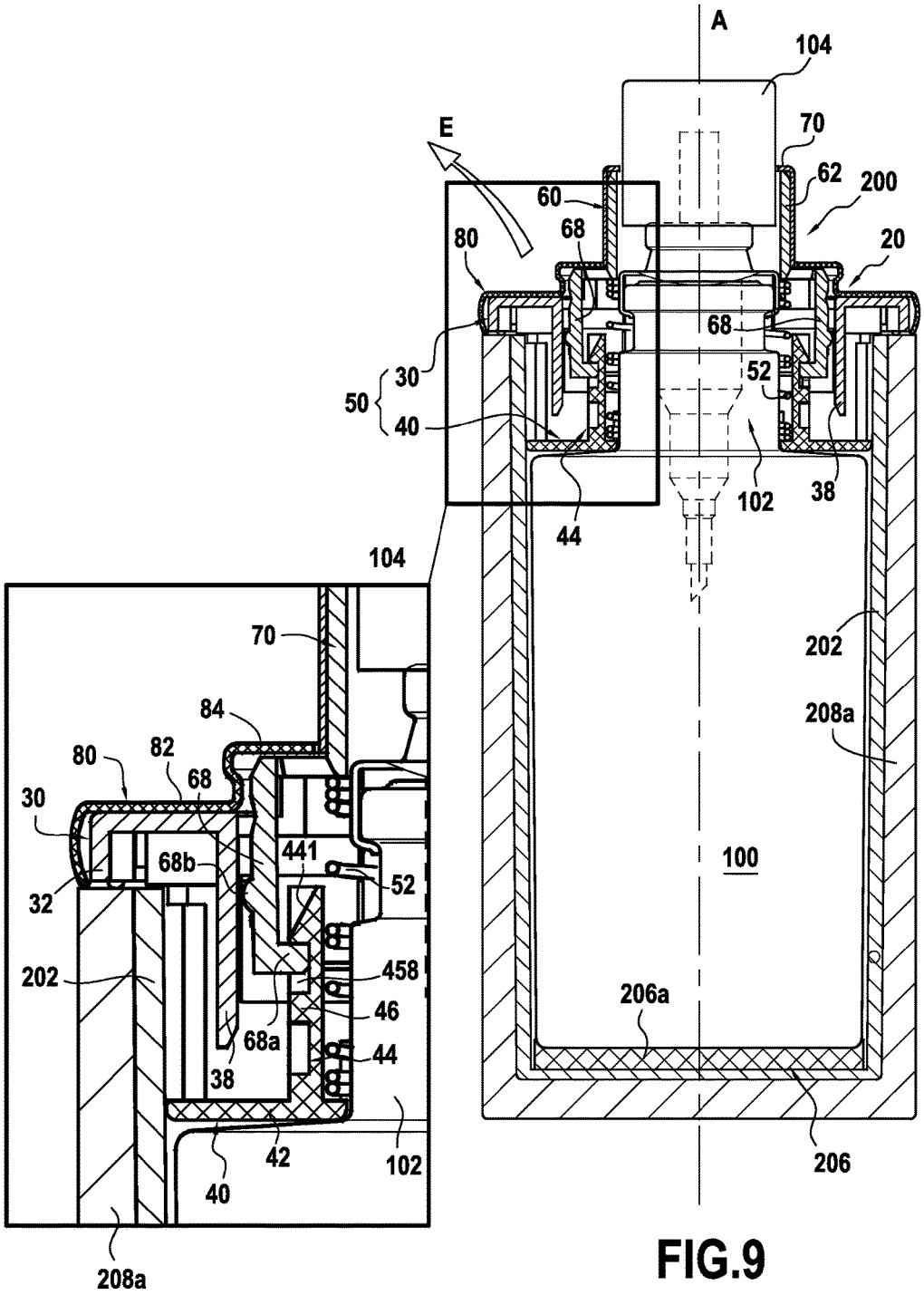
FIG. 9 is a section view of a detail of the FIG. 1A packaging device, showing the removable assembly in its position unlocked from the open end of the sheath.

Comparing FIGS. 1A and 9, it should be observed that the packaging device 200 of the invention includes a removable assembly 20 that is suitable for being fastened in removable manner to the open end 204 of the sheath 202 between a locked position in which the refill 100 is held in the sheath 202 (see FIG. 1A) and an unlocked position in which the refill 100 can be removed from the sheath 202 (see FIG. 9). In particular, the removable assembly 20 is arranged around the neck 102 and around the control element 104 of the refill 100.

Figure 1B:
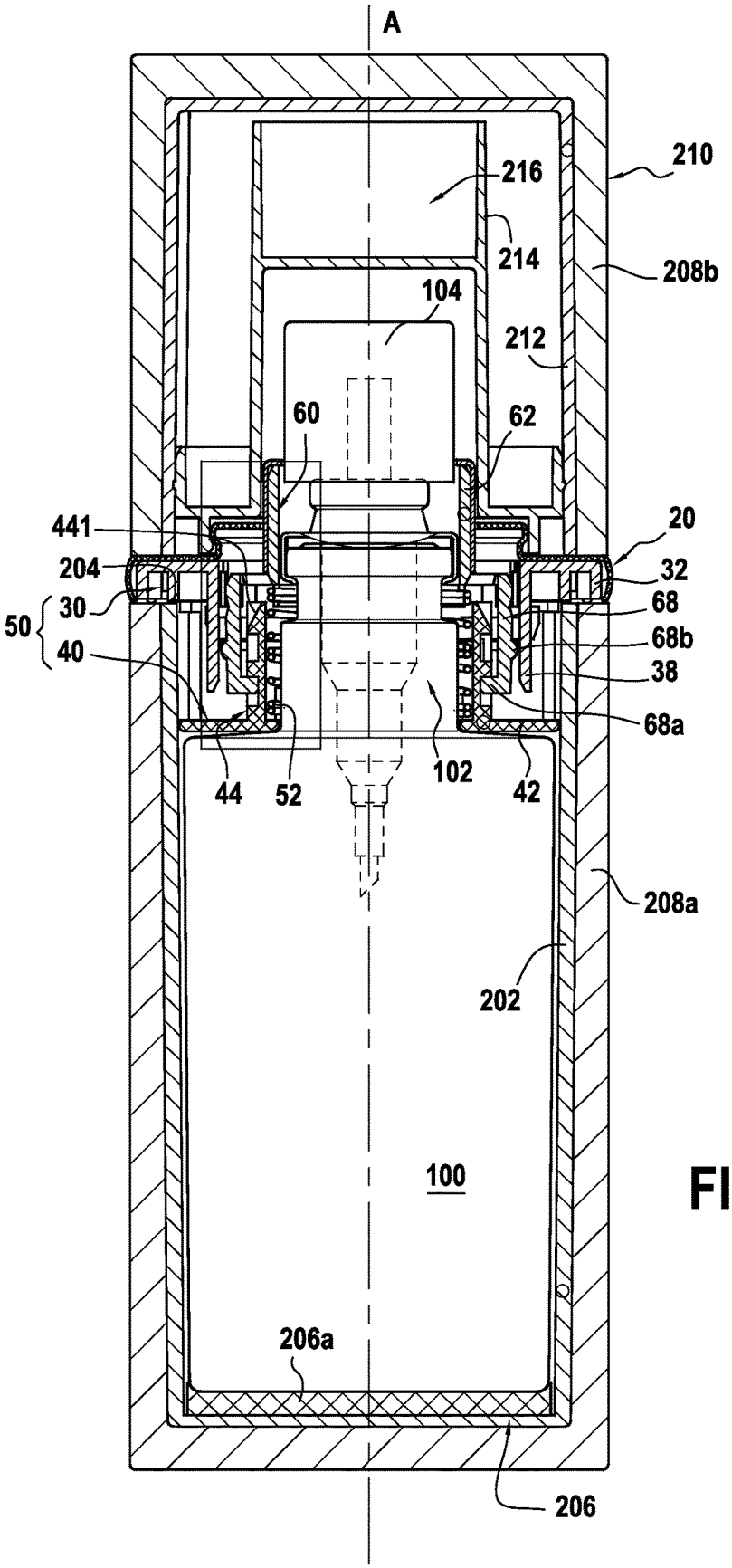
FIG. 1B is a longitudinal section view of the FIG. 1B packaging assembly, with the packaging device being provided with a cap.

In FIG. 1B, it can be seen that the packaging device 200 may include a cap 210 that includes an internal wall 212 and an insert 214 that defines a housing 216 between said insert 214 and the internal wall 212. If necessary, a ballast weight may be arranged in said housing 216. In addition, the internal wall 214 of the cap 210 is housed in an upper casing 208*b*.

The axis A of the packaging device is defined as being the longitudinal axis of the packaging device 200.

With reference to FIGS. 1A to 4 and 9, it can be seen that the removable assembly 20 includes a retainer interface 50 comprising an anchor member 30 that is suitable for being anchored to the open end 204 of the sheath 202, and a guide member 40. The anchor member 30 and the guide member 40 are clipped together in permanent manner.

Figure 5A:
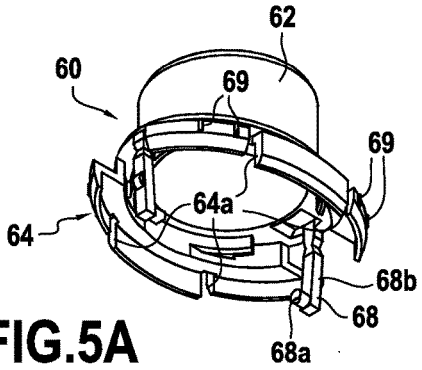
FIG. 5A is a perspective view from below of the actuator member of the removable assembly.
Figure 5B:
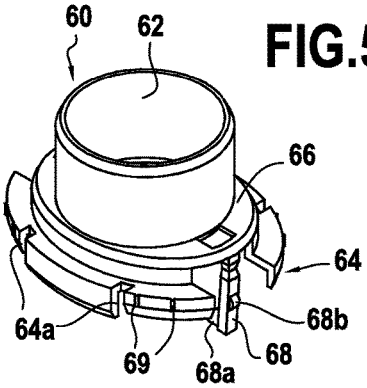
FIG. 5B is a perspective view from above of the FIG. 5A actuator member.

With reference to FIGS. 5A and 5B, it can be seen that the removable assembly 20 further includes an actuator member 60 that is suitable for being moved axially along the axis A relative to the retainer interface 50, being guided by the guide member 40 and subjected to thrust from a spring 52 that is arranged between the retainer interface 50 and the actuator member 60. In this way, the actuator member 60 may be taken relative to the retainer interface 50 into an actuated position, in which the actuator member 60 urges the anchor member 30 to be anchored to the open end 204 of the sheath 202, and into a disengaged position in which it releases the anchor member 30 from the open end 204 of the sheath 202. Thus, in order to lock the removable assembly 20 onto the open end 204 of the sheath 202 or to unlock it therefrom, it suffices for the user to press the actuator member 60 towards the sheath 202, while holding the sheath.

The removable assembly 20 is described in greater detail below with reference to FIGS. 2A to 5B.

Figure 2A:
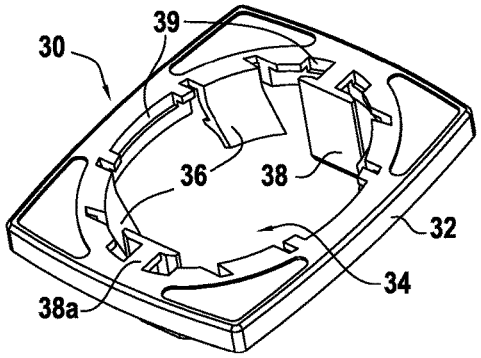
FIG. 2A is a perspective view from above of the anchor member of the removable assembly.
Figure 2B:
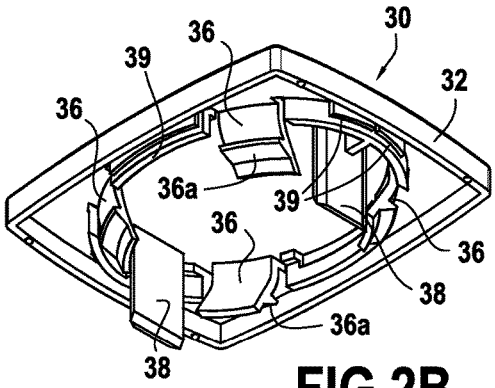
FIG. 2B is a perspective view from below of the FIG. 2A anchor member.

As shown in FIGS. 2A and 2B, the anchor member 30 comprises a pierced plate 32 that specifically presents a generally rectangular shape that defines an opening 34 that is a generally elliptical. As can be seen in particular in FIGS. 1A and 1B, the shape and the dimensions of the plate 32 are adapted to the shape and the dimensions of the open end of the sheath 202, such that the plate 32 bears against the open end 204 of the sheath 202, and the opening 34 in the plate is on the same axis A as the opening in the sheath 202. In the embodiment, the shape and the dimensions of the opening 34 and the shape and the dimensions of the sheath are substantially the same.

The anchor member 30 further includes clip-fastener tongues 36 for clipping in the inside wall of the sheath 204, specifically four tongues in this embodiment, regularly distributed circumferentially along the open 34. On its face facing the inside wall of the sheath 202, each of the clip-fastener tongues 36 includes a clip-fastener rib 36*a* that is suitable for co-operating with a corresponding groove 208 formed in the inside wall of the sheath 202, when the removable assembly 20 is in its position locked to the open end 204 of the sheath 202. As can be seen in FIGS. 1A and 1B, as a result of their natural springiness, the clip-fastener tongues 36 are naturally oriented radially away from the wall of the sheath 202, such that the ribs 36*a* of the tongues 36 escape from the grooves 208 formed in the inside wall of the sheath 202, when the removable assembly is unlocked from the open end of the sheath.

Figure 3A:
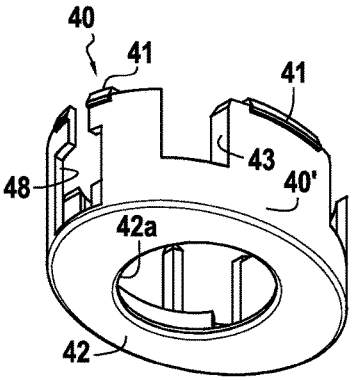
FIG. 3A is a perspective view from below of the guide member of the removable assembly.
Figure 3B:
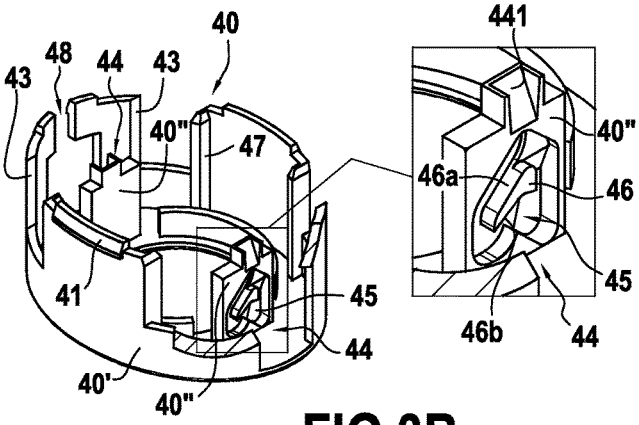
FIG. 3B is a perspective view from above of the FIG. 3A guide member, with a cut-away showing a heart-shaped cam that is carried by the guide member.

With reference to FIGS. 3A and 3B, it can be seen that the wall 40' of the guide member 40 is generally tubular and includes four openings 43. When the guide member 40 and the anchor member 30 are clipped together, the openings 43 face the clip-fastener tongues 36 of the anchor member 30. The dimensions and the shape of the openings 43 are adapted to the dimensions and the shape of the clip-fastener tongues 36 of the anchor member 30.

The guide member 40 further includes a bottom wall 42 that faces the bottom wall 206 of the sheath 202, and in which an opening 42*a* is formed.

The guide member 40 further includes heart-shaped cams 44, specifically two cams in this embodiment, that are diametrically opposite each other. Each of the heart-shaped cams 44 is formed in an axial wall portion 40" that projects in the axial direction A from the bottom wall 42 of the guide member 40. The two portions 40" are arranged on the bottom wall 42, set back from the wall 40' of the guide member 40, going away from the wall of the sheath 202.

Each heart-shaped cam 44 presents a heart-shaped path 45 that faces the wall of the sheath 202, said heart-shaped path 45 being "recessed" into the portion 40" around a guide element 46 that projects "in relief" relative to the heart-shaped path 45. It should be observed that the wall 40' of the guide member 40 further presents two openings 48 that face the heart-shaped cams 44.

Figure 4:
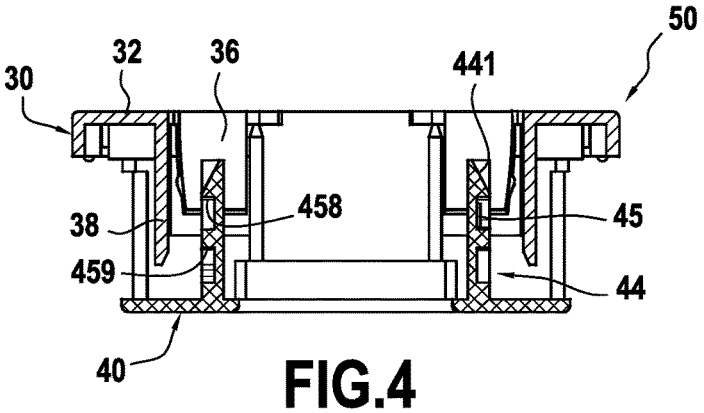
FIG. 4 is a longitudinal section view showing, in the assembled situation, the retainer interface and the guide member of the removable assembly.

As can be seen in FIG. 4, anti-escape abutments 38 are formed on the anchor member 30, positioned to face the heart-shaped paths 45 of the heart-shaped cams 44 when the anchor member 30 and the guide member 40 are clipped together. Each anti-escape abutment 38 is arranged on the edge of the opening 34 of the plate 32 and extends downwards along the axial direction A. The abutments 38 are connected to the plate 32 of the anchor member 30 by a junction arm 38*a*.

The anchor member 30 and the guide member 40 are clipped together by means of recesses 39 formed in the anchor member 30 co-operating with ribs 41 formed on the outside wall of the guide member 40. In the embodiment, there are six ribs 41 and six recesses 39. As can be seen in FIG. 4, once fastened together, the anchor member 30 and the guide member 40 form the retainer interface 50.

With reference to FIGS. 5A and 5B, it can be seen that the actuator member 60 comprises a tubular presser portion 62 that is extended by a tubular base 64, the presser portion 62 and the base 64 being connected together by a radial connection piece 66.

The actuator member 60 includes guide grooves 64*a* that are suitable for co-operating with splines 47 that are formed on the inside wall of the guide member 40 so as to guide the actuator member 60 in axial movement relative to the retainer interface, while preventing them from turning relative to each other. In the embodiment, there are four guide grooves 64*a* and four splines 47. In a variant, the actuator member 60 could include the splines 47, and the guide member 40 could include the guide grooves 64*a*.

With reference to FIGS. 1A and 1B, it can be seen that the presser portion 62 of the actuator member may be covered by a crimped cap 70. An additional crimped cap 80 may be arranged on the retainer interface 50. In particular, it should be observed that the cap 80 comprises a lateral tubular portion 82 that fits the dimensions of the plate 32, and a central tubular portion 84 surrounding the cap 70 and that is shaped so that is does not interfere with the axial movement of the actuator member 60, and also so as to promote the clip-fastening of the upper casing 2008*b*.

The actuator member 60 further includes flexible tabs 68, specifically two tabs in this embodiment, the free end of each of the tabs 68 being provided with a follower pin 68*a* that is suitable for co-operating with a respective one of the heart-shaped paths 45 of the heart-shaped cams 44 when the actuator member 60 is mounted on the retainer interface 50.

Preferably, the flexible tabs 68 slope radially a little away from the wall of the sheath 202, such that the follower pins 68*a* exert a radial force on the heart-shaped cams 44, and naturally tend to be engaged in the heart-shaped path 45 of the heart-shaped cams 44.

It should be observed that each face of a flexible tab 68 that faces the wall of the sheath includes a lug 68*b* that is suitable for being positioned in abutment against the anti-escape abutments of the anchor member 30. In the actuated position, the tabs 68 are arranged against the inside faces of the anti-escape abutments that prevent the lugs 68*a* from escaping from the heart-shaped cams.

As can be seen in FIGS. 1A and 1B and 9, after the spring 52 has been put in place to bear against the bottom wall 42 of the guide member 40, the actuator member is inserted, in part, into the retainer interface 50, such that the guide grooves 47 of the guide member 40 are engaged in the splines of the actuator member 60, and such that the follower pins 68*a* are engaged in the heart-shaped paths 45. Thus, when the removable assembly 20 is mounted, the spring 52 exerts thrust on the actuator member 60, directed away from the bottom wall 206 of the sheath 202.

Figure 6:
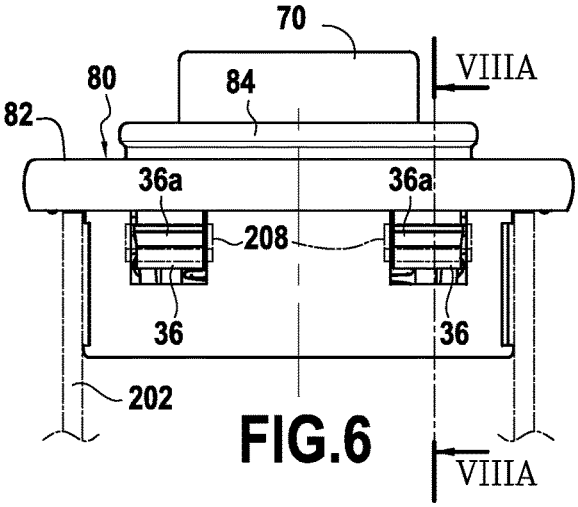
FIG. 6 is a front view of the removable assembly locked to the open end of the sheath.
Figure 8A:
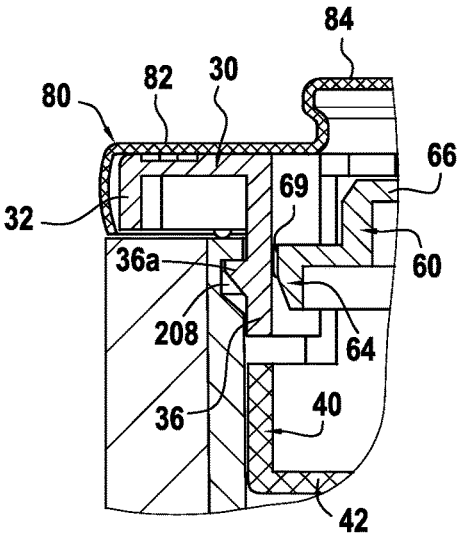
FIG. 8A is a view of a detail on plane VIIIA-VIIIA in FIG. 6.

As can be seen in FIGS. 5A, 5B, and 8A, on its outside face, the base 66 of the actuator member 60 includes presser surfaces 69, specifically eight presser surfaces, that are suitable for co-operating with the clip-fastener tongues 36 of the anchor member 30 so as to push the tongues towards the sheath 202 when the actuator member 40 reaches its actuated position, so that the ribs 36*a* catch in the grooves 208 of the sheath 202 (see more particularly FIGS. 6 and 8A).

Figure 7:
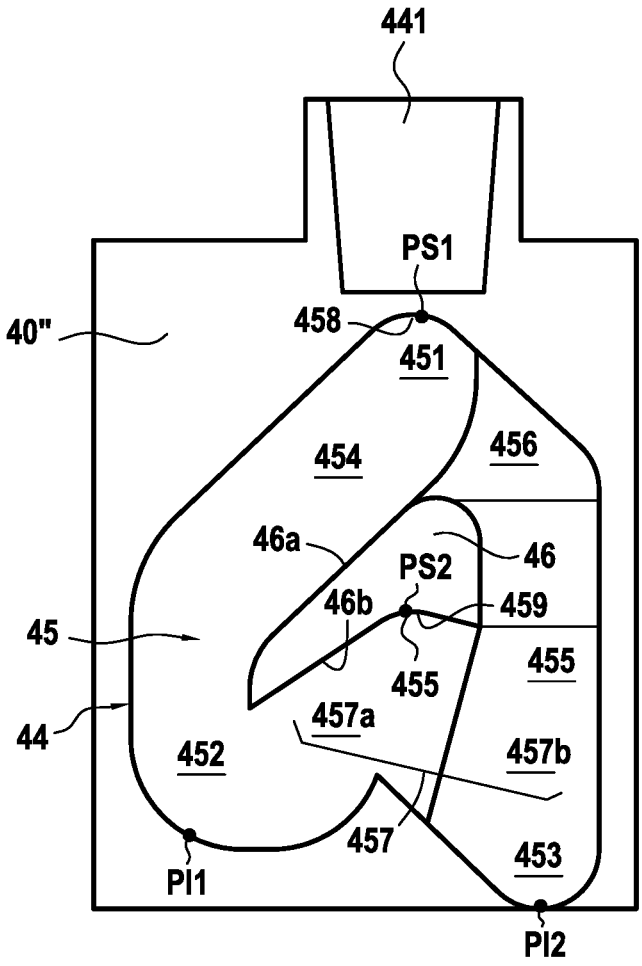
FIG. 7 is a front view of a heart-shaped cam of the actuator member in FIGS. 3A and 3B.

The heart-shaped cam 44 and the co-operation between the follower pin 68*a* and the heart-shaped path 45 are described in detail below with reference to FIG. 7.

In this embodiment, the heart-shaped path 45 of each of the heart-shaped cams 44 has the shape of an upsidedown heart, with the tip pointing upwards. The heart-shaped path 45 is recessed into the portion 40" of the guide member 40, forming a guide element 46 "in relief" for guiding the follower pin 68*a* in said heart-shaped path 45. The guide element 46 presents a first ramp 46*a* that slopes towards the bottom wall 206 of the sheath 202 relative to the direction of travel of the follower pin in the heart-shaped path 45, and a second ramp 46*b* that slopes away from the bottom wall of the sheath 202 relative to the direction of travel of the follower pin 68*a* in the heart-shaped path 45.

In this embodiment, the heart-shaped path 45 presents a "tip" 451, a first lobe 452, and a second lobe 453, and defines an actuation track 454, a disengagement track 455, and a junction portion 457 between the actuation track 454 and the disengagement track 455. The junction portion 457 comprises a first flap 457*a* and a second flap 457*b*.

The heart-shaped path 45 further presents a top abutment 458 that is formed in the tip of the heart, and a bottom abutment 459 that is formed by the second ramp 46*b* of the guide element 46. The first flap 457*a* of the heart-shaped path 45 thus extends from the bottom end of the first lobe 452 to the bottom abutment 459, and the second flap 457*b* extends from the bottom abutment 459 to the bottom end of the second lobe 453.

In FIG. 3*b*, it should be observed that, at their top ends, each of the portions 40" of the guide member 40 includes a groove that forms a ramp 441 that extends down to a shoulder that is oriented towards the bottom wall 206 of the sheath 204 and that leads to the heart-shaped path 45 at the tip 451 of said heart-shaped path 45. The shoulder corresponds to the top abutment 458 of the heart-shaped path 45. In this respect it should be observed in FIGS. 1A and 1B that the free end of the follower pin 68*a* may include a beveled portion 68*c* that makes it easier for the follower pin 68*a* to pass into the groove 441 of the heart-shaped cam 44 during mounting. While assembling the actuator member 60 and the guide member 40 together, the follower pins 68*a* are presented at the top of the ramps 441. Pressing the actuator member downwards causes the tabs 68 to flex until the pins 68*a* pass over the ramps 441 and into the heart-shaped cams. Under the effect of the spring 52, each follower pin is blocked against the top abutment 458 of the heart-shaped path 45. The top abutment 458 also prevents the follower pin 68*a* from returning into the ramp 441 of the portion 40".

The heart-shaped cam 44 defines four individual positions for the follower pin 68*a* in the heart-shaped path 45. A first stable position PS1 of the follower pin 68*a* corresponds to the disengaged position of the actuator member 60. In the first stable position PS1, the follower pin 68*a* is blocked in the heart-shaped path 45 against the top abutment 458 under the effect of the thrust of the spring 52.

A second stable position PS2 of the follower pin 68*a* corresponds to the actuated position of the actuator member 60. In the second stable position, the follower pin 68*a* is blocked in the heart-shaped path 45 by the bottom abutment 459 under the effect of the spring 52.

A first unstable position PI1 of the follower pin 68*a* is defined beyond the first stable position PS1 in the bottom end of the first lobe 452, after the follower pin 68*a* has moved towards the bottom wall 206 of the sheath 202 from its first stable position PS1. This operation causes the spring 52 to compress.

A second unstable position PI2 of the follower pin is defined beyond the second stable position PS2 in the bottom end of the second lobe 453, after the follower pin 68*a* has moved towards the bottom wall 204 of the sheath 202 from its second stable position PS2. This operation causes the spring 52 to compress.

As shown in FIG. 1A, when the removable assembly 20 is locked onto the open end 204 of the sheath 202, the actuator member 60 is in the actuated position. As described above, in the actuated position of the actuator member 60, the follower pin 68*a* is blocked in the second stable position PS2 by the bottom abutment 459 under the effect of the spring 52 that exerts thrust on the actuator member, away from the bottom wall 206 of the sheath 202. Thus, as shown in FIGS. 6 and 8A, in the second stable position PS2 of the follower pin 68*a*, the presser portions 69 of the actuator member 60 push the clip-fastener tongues 36 radially towards the inside wall of the sheath 202, such that the ribs 36*a* of the tongues 36 catch in the grooves 208 of the sheath 202.

In order to unlock the removable assembly 20 from the open end 204 of the sheath 202, the user presses the presser portion 62 of the actuator member 60 towards the bottom wall 206 of the sheath 202. This causes the follower pin 68*a* to move in the second flap 457*b* of the heart-shaped path 45 until it reaches the second unstable position PI2. When the user stops pressing on the presser portion 62, the actuator member 60 is thrust away from the bottom wall 206 of the sheath 202 under the effect of the thrust exerted by the spring 52. This causes the follower pin 68*a* to move in the disengagement track 455 until it reaches the first stable position PS1 in which the actuator member is in its disengaged position.

Figure 8B:
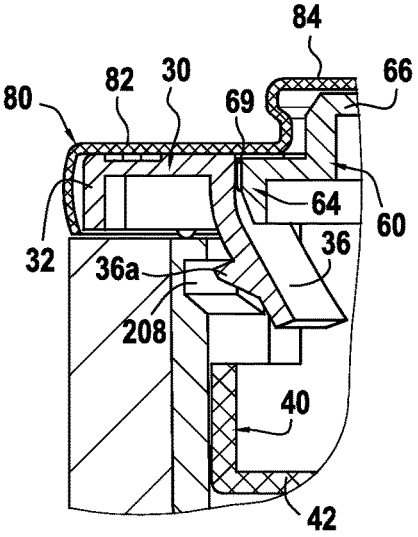
FIG. 8B is a view of a detail on plane VIIIA-VIIIA in FIG. 6, when the removable assembly is unlocked from the open end of the sheath.

As can be seen in FIG. 8B, in the disengaged position of the actuator member 60, the clip-fastener tongues 36 of the anchor member 30 are no longer subjected to pressure exerted by the presser portions 69 of the actuator member 60, and, as a result of their natural springiness, they spring back away from the wall of the sheath 202. The user can thus remove the removable assembly 20 from the open end 204 of the sheath 202, as represented by arrow E in FIG. 9.

In order to lock the removable assembly 20 once again onto the open end 204 of the sheath 202, it suffices for the user to press once again on the presser portion 62 of the actuator member 60, which causes each follower pin 68*a* to move in its actuation track 452, until it reaches the first unstable position PI1. When the user stops pressing on the presser portion 62, the actuator member 60 is subjected to the thrust of the spring 52, which causes the follower pin to travel along the first flap 457*a*, until it reaches the second stable position PS2.

The invention claimed is:

1. A packaging device for packaging a fluid refill, the packaging device comprising a sheath having an open end, and a removable assembly that is suitable for being fastened in removable manner to the open end of the sheath between a locked position in which the refill is held in the sheath, and an unlocked position in which the refill is removable from the sheath, the removable assembly comprising both a retainer interface that co-operates with the open end of the sheath and that presents an anchor member, and also an actuator member that co-operates with the retainer interface while being suitable for being moved relative thereto, the actuator member thus being suitable for being taken, by an axial movement relative to the retainer interface, into an actuated position in which the actuator member urges the anchor member to be anchored to the open end of the sheath, and a disengaged position in which the actuator member releases the anchor member and enables the removable assembly to be disengaged from the open end of the sheath.

2. A packaging device as claimed in claim 1, wherein the removable assembly forms a unitary assembly.

3. A packaging device claimed in claim 1, wherein the actuator member is urged to move towards the disengaged position thereof, after said actuator member has moved axially from the actuated position thereof.

4. A packaging device as claimed in claim 3, wherein the actuator member moves axially from the actuated position thereof by means of said actuator member being pushed towards an inside of the sheath, and said actuator member moves axially towards the disengaged position thereof by means of said actuator member being thrust towards an outlet of the sheath.

5. A packaging device as claimed in claim 1, comprising at least one spring for urging the actuator member to move towards the disengaged position thereof, after said actuator member has moved axially from the actuated position thereof.

6. A packaging device as claimed in claim 4, wherein one of the actuator member and the retainer interface includes a follower pin that co-operates with at least one heart-shaped cam that is secured to one of the actuator member and the retainer interface, said cam defining a heart-shaped path for the pin.

7. A packaging device as claimed in claim 6, wherein the follower pin is formed on a tab of one of the retainer interface and the actuator member.

8. A packaging device as claimed in claim 7, wherein the retainer interface presents at least one anti-escape abutment that is arranged facing the tab so as to prevent the follower pin from escaping from the heart-shaped path.

9. A packaging device as claimed in claim 1, wherein the anchor member includes at least one projection that is suitable for co-operating with at least one recess formed in a wall of the sheath, when the actuator member reaches the actuated position thereof.

10. A packaging device as claimed in claim 9, wherein the anchor member includes a tongue on which the projection is formed.

11. A packaging device as claimed in claim 10, wherein the actuator member includes at least one presser surface that is suitable for pushing the tongue towards the wall of the sheath, so as to anchor the anchor member to the open end of the sheath.

12. A packaging device as claimed in claim 10, wherein the tongue is resilient and presents a natural position that does not enable the anchor member to be anchored to the open end of the sheath.

13. A packaging device as claimed in claim 1, wherein the retainer interface and the actuator member co-operate with each other via longitudinal guide surfaces.

14. A packaging assembly comprising the fluid refill having a neck portion and the packaging device as claimed in claim 1, wherein the removable assembly is arranged around the neck portion of the refill.

15. A packaging device as claimed in claim 1, wherein the fluid refill includes a fluid, and the fluid is a cosmetic.

16. A packaging device as claimed in claim 1, wherein the refill presents a neck portion and the removable assembly is configured to be arranged around the neck portion.

17. A packaging device as claimed in claim 1, wherein the removable assembly is configured to be arranged around a control member of the refill.

18. A packaging device as claimed in claim 1, wherein the refill includes one of a spray, a pump and a bottle.

19. A packaging assembly comprising the fluid refill and the packaging device as claimed in claim 1, wherein the removable assembly is arranged around a control member of said refill.

20. A packaging assembly comprising the packaging device as claimed in claim 1 and the fluid refill including at least one of a spray, a pump and a bottle.

* * * * *